US011018418B2

(12) United States Patent
Kim et al.

(10) Patent No.: US 11,018,418 B2
(45) Date of Patent: May 25, 2021

(54) CHIP ANTENNA AND CHIP ANTENNA MODULE INCLUDING THE SAME

(71) Applicant: Samsung Electro-Mechanics Co., Ltd., Suwon-si (KR)

(72) Inventors: Jae Yeong Kim, Suwon-si (KR); Sung Yong An, Suwon-si (KR); Sang Jong Lee, Suwon-si (KR); Seong Hee Choi, Suwon-si (KR); Kyu Bum Han, Suwon-si (KR); Jeong Ki Ryoo, Suwon-si (KR); Byeong Cheol Moon, Suwon-si (KR); Chang Hak Choi, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 246 days.

(21) Appl. No.: 16/185,118

(22) Filed: Nov. 9, 2018

(65) Prior Publication Data

US 2019/0237861 A1 Aug. 1, 2019

(30) Foreign Application Priority Data

Jan. 31, 2018 (KR) ..... 10-2018-0012041
Jun. 19, 2018 (KR) ..... 10-2018-0070357

(51) Int. Cl.
*H01Q 1/38* (2006.01)
*H01Q 15/14* (2006.01)
(Continued)

(52) U.S. Cl.
CPC ..... *H01Q 1/38* (2013.01); *H01Q 1/2283* (2013.01); *H01Q 1/48* (2013.01); *H01Q 9/0407* (2013.01);
(Continued)

(58) Field of Classification Search
CPC .... H01Q 5/378; H01Q 9/0414; H01Q 9/0407; H01Q 1/2283; H01Q 19/005
See application file for complete search history.

(56) References Cited

U.S. PATENT DOCUMENTS 10,305,172 B2 * 5/2019 Noori ..... H01Q 1/243
10,892,547 B2 * 1/2021 Rakib ..... H01Q 25/002
(Continued)

FOREIGN PATENT DOCUMENTS

EP 2 065 975 A1 6/2009
KR 10-2012-0021037 A 3/2012
(Continued)

OTHER PUBLICATIONS

Korean Office Action dated Mar. 26, 2019 in counterpart Korean Patent Application No. 10-2018-0070357 (4 pages in English and 5 pages in Korean).

*Primary Examiner* — Ab Salam Alkassim, Jr.
(74) *Attorney, Agent, or Firm* — NSIP Law

(57) ABSTRACT

A chip antenna includes a radiation portion having a block shape and a first surface and a second surface opposing each other, and configured to receive and radiate a feed signal as an electromagnetic wave; a first block made of a dielectric material and coupled to the first surface of the radiation portion; a second block made of a dielectric material and coupled to the second surface of the radiation portion; a ground portion having a block shape and coupled to the first block, and configured to reflect the electromagnetic wave radiated by the radiation portion back toward the radiation portion; and a director having a block shape and coupled to the second block, wherein an overall width of the ground portion, the first block, and the radiation portion is 2 mm or less, and the first block has a dielectric constant of 3.5 or more to 25 or less.

15 Claims, 9 Drawing Sheets

(51) Int. Cl.

| | |
|---|---|
| ***H01Q 9/04*** | (2006.01) |
| ***H01Q 1/48*** | (2006.01) |
| ***H01Q 1/22*** | (2006.01) |
| ***H01Q 19/30*** | (2006.01) |
| ***H01Q 11/02*** | (2006.01) |
| *H01Q 1/24* | (2006.01) |
| *H01Q 19/00* | (2006.01) |

(52) U.S. Cl.
CPC ..... *H01Q 11/02* (2013.01); *H01Q 15/14* (2013.01); *H01Q 19/30* (2013.01); *H01Q 1/243* (2013.01); *H01Q 9/0414* (2013.01); *H01Q 19/005* (2013.01)

(56) References Cited

U.S. PATENT DOCUMENTS

| | | | | |
|---|---|---|---|---|
| 10,965,004 | B2 * | 3/2021 | Park | H01Q 1/2283 |
| 10,965,007 | B2 * | 3/2021 | Kim | H01Q 1/2283 |
| 2005/0195110 | A1 * | 9/2005 | Lin | H01Q 9/0414 343/700 MS |
| 2012/0050126 | A1 | 3/2012 | Chung et al. | |
| 2014/0239427 | A1 * | 8/2014 | Huang | H01L 21/486 257/428 |
| 2015/0070228 | A1 * | 3/2015 | Gu | H01Q 1/2283 343/727 |
| 2015/0325925 | A1 * | 11/2015 | Kamgaing | H01L 21/52 343/893 |
| 2016/0087348 | A1 * | 3/2016 | Ko | H01Q 1/521 455/73 |
| 2017/0201028 | A1 * | 7/2017 | Eberhardt | H01P 5/103 |
| 2018/0048075 | A1 * | 2/2018 | Park | H01Q 1/528 |
| 2019/0089052 | A1 * | 3/2019 | Yong | H01Q 1/2283 |
| 2019/0097304 | A1 * | 3/2019 | Hsiao | H01L 23/49838 |
| 2019/0190120 | A1 * | 6/2019 | Kim | H01Q 1/523 |
| 2019/0333882 | A1 * | 10/2019 | Kamgaing | H01Q 19/005 |
| 2020/0028238 | A1 * | 1/2020 | Park | H01Q 1/38 |
| 2020/0083593 | A1 * | 3/2020 | Choi | H01Q 9/30 |
| 2020/0091583 | A1 * | 3/2020 | Choi | H01Q 9/42 |
| 2020/0136255 | A1 * | 4/2020 | Choi | H01Q 1/2291 |
| 2020/0203834 | A1 * | 6/2020 | Asaf | H01Q 1/243 |
| 2020/0259267 | A1 * | 8/2020 | Park | H01Q 1/48 |
| 2020/0259269 | A1 * | 8/2020 | Kim | H01Q 9/0414 |
| 2020/0303805 | A1 * | 9/2020 | Ryoo | H01Q 21/28 |
| 2020/0303821 | A1 * | 9/2020 | Lee | H01Q 5/335 |
| 2020/0313279 | A1 * | 10/2020 | Kim | H01Q 21/28 |
| 2020/0328518 | A1 * | 10/2020 | Park | H01Q 1/2283 |
| 2020/0328530 | A1 * | 10/2020 | Park | H01Q 1/2283 |
| 2020/0335870 | A1 * | 10/2020 | Kim | H01Q 21/28 |
| 2021/0036407 | A1 * | 2/2021 | Kim | H01Q 9/0407 |
| 2021/0050651 | A1 * | 2/2021 | Jung | H01Q 1/2283 |
| 2021/0066782 | A1 * | 3/2021 | Cho | H01Q 9/0407 |

FOREIGN PATENT DOCUMENTS

| | | | |
|---|---|---|---|
| KR | 10-2013-0040813 | A | 4/2013 |
| KR | 10-1355865 | B1 | 2/2014 |
| WO | WO 2008/035526 | A1 | 3/2008 |
| WO | WO 2011/117621 | A2 | 9/2011 |

* cited by examiner

XII-XII'

CHIP ANTENNA AND CHIP ANTENNA MODULE INCLUDING THE SAME

CROSS-REFERENCE TO RELATED APPLICATIONS

This application claims the benefit under 35 USC 119(a) of Korean Patent Application Nos. 10-2018-0012041 filed on Jan. 31, 2018, and 10-2018-0070357 filed on Jun. 19, 2018, in the Korean Intellectual Property Office, the entire disclosures of which are incorporated herein by reference for all purposes.

BACKGROUND

1. Field

This application relates to a chip antenna and a chip antenna module including the same.

2. Description of Related Art

Fifth generation (5G) communications systems are commonly implemented in higher frequency (mmWave) bands, such as bands of 10 GHz to 100 GHz, to achieve a higher data rate. To decrease propagation loss of radio waves and increase a transmission distance of the radio waves, beamforming, large-scale multiple-input multiple-output (MIMO), full-dimension MIMO (FD-MIMO), an array antenna, analog beamforming, and large-scale antenna techniques have been discussed in relation to 5G communications systems.

Mobile communications terminals, such as cellular phones, personal digital assistants (PDA), navigation devices, and laptop computers, supporting radio communications have been developed to support functions such as code-division multiple access (CDMA), wireless local area network (WLAN), digital multimedia broadcasting (DMB), and near-field communication (NFC). One of the important components enabling these functions is an antenna.

In a millimeter wave communications band, a wavelength is decreased to several millimeters, and it is thus difficult to use a conventional antenna. Therefore, an antenna module appropriate for the millimeter wave communications band is needed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna for radio communications in a millimeter wave communications band is configured to be mounted on a board, receive a feed signal from a signal processing element, and externally radiate the feed signal, and includes a radiation portion having a block shape and a first surface and a second surface opposing each other, and configured to receive and radiate the feed signal as an electromagnetic wave; a first block made of a dielectric material and coupled to the first surface of the radiation portion; a second block made of a dielectric material and coupled to the second surface of the radiation portion; a ground portion having a block shape, coupled to the first block so that the first block is between the ground portion and the radiation portion, and configured to reflect the electromagnetic wave radiated by the radiation portion back toward the radiation portion; and a director having a block shape and coupled to the second block so that the second block is between the director and the radiation portion, wherein an overall width of the ground portion, the first block, and the radiation portion is 2 mm or less, and the first block has a dielectric constant of 3.5 or more to 25 or less.

The second block may be made of the same dielectric material as the first block.

Each of the radiation portion, the ground portion, and the director may include a first conductor bonded to either one or both of the first block and the second block; and a second conductor disposed on a surface of the first conductor.

The first block may have a first surface to which the radiation portion is bonded and a second surface to which the ground portion is bonded, the second block may have a first surface to which the radiation portion is bonded and a second surface to which the director is bonded, and a distance between the first surface and the second surface of the first block may be greater than a distance between the first surface and the second surface of the second block.

The chip antenna of claim 1, wherein a distance between a first surface of the ground portion bonded to the first block and a second surface of the ground portion opposing the first surface of the ground portion may be greater than a distance between a first surface of the radiation portion bonded to the first block and a second surface of the radiation portion opposing the first surface of the radiation portion.

A size of the director may be the same as a size of the radiation portion.

A length of the director may be smaller than a length of the radiation portion.

A length of the second block may be the same as a length of the director.

The radiation portion may include a first radiation portion and a second radiation portion spaced apart from each other, and the director may include a first director and a second director spaced apart from each other.

The ground portion may include a first ground portion and a second ground portion spaced apart from each other, the first ground portion may be disposed on a straight line with the first radiation portion and the first director, and the second ground portion may be disposed on a straight line with the second radiation portion and the second director.

In another general aspect, an antenna module includes a board having a surface divided into a ground region, a feeding region, and an element mounting portion; a signal processing element mounted on the element mounting portion and configured to transmit a radiation signal to the feeding region; a chip antenna mounted on one surface of the board and configured to radiate a radiation signal having a horizontal polarization; and a patch antenna disposed on another surface of the board and configured to radiate a radiation signal having a vertical polarization, wherein the chip antenna has a structure in which are sequentially stacked a ground portion having a conductivity and a block shape, a first block made of a dielectric material, a radiation portion having a conductivity and a block shape, a second block made of a dielectric material, and a director having a conductivity and a block shape, the ground portion is mounted on the ground region and the radiation portion is mounted on the feeding region, and the chip antenna and the patch antenna are disposed so that they do not face each other.

The feeding region may include a dummy pad, and the director may be bonded to the dummy pad.

The director may not be electrically connected to the board.

The patch antenna may be disposed only on a region of the board facing either one or both of the ground region and the element mounting portion.

The radiation portion may be spaced apart from the ground region by 0.2 mm or more.

The antenna module may further include another chip antenna having a same structure as the chip antenna so that the antenna module includes two chip antennas, the two chip antennas may be mounted on the board as a pair so that the radiation portions of the two chip antennas face each other and the two chip antennas function as a dipole antenna, and a spacing between the two chip antennas may be 0.2 mm or more to 0.5 mm or less.

The feeding region may be disposed along an edge of the board.

The antenna module may further include a feed pad disposed in the feeding region, and the radiation portion may be configured to directly receive the radiation signal from the signal processing element through the feed pad, and externally radiate the radiation signal.

The patch antenna may include a feeding electrode disposed in the board and electrically connected to the signal processing element; and a non-feeding electrode facing the feeding electrode and spaced apart from the feeding electrode by a predetermined distance.

The antenna module may further include a ground pad disposed on the surface of the board in the ground region; and a feed pad disposed on the surface of the board in the feeding region, wherein the ground portion of the chip antenna may be mounted on the ground pad by an electrically conductive bond, and the radiation portion of the chip antenna may be mounted on the feed pad by an electrically conductive bond.

In another general aspect an antenna module includes a board having a surface divided into a ground region and a feeding region, and including wiring layers; a signal processing element mounted on the board and configured to transmit a radiation signal to the feeding region; and two chip antennas mounted on one surface of the board in a pair and configured to radiate a radiation signal having a horizontal polarization and function as a dipole antenna, wherein each of the two chip antennas has a structure in which are sequentially stacked a ground portion having a conductivity and a block shape, a first block made of a dielectric material, a radiation portion having a conductivity and a block shape, a second block made of a dielectric material, and a director having a conductivity and a block shape, the board further includes two feed pads respectively bonded to the radiation portions of the two chip antennas, and two feed vias respectively extending from the two feed pads and connected to the wiring layers of the board, the two feed pads are spaced apart from each other on a straight line so that end portions of the two feed pads face each other, and the two feed vias respectively extend from the end portions of the two pads facing each other.

The antenna module may further include a patch antenna disposed on another surface of the board and configured to radiate a radiation signal having a vertical polarization.

In another general aspect, a chip antenna includes a ground portion having a block shape; a first block bonded to the ground portion; a radiation portion having a block shape, bonded to the first block, and configured to emit electromagnetic waves; a second block bonded to the radiation portion; a director having a block shape, bonded to the second block, and configured to emit an electromagnetic wave constructively interfering with the electromagnetic wave emitted by the radiation portion; wherein the ground portion, the radiation portion, and the director are made of a first type of material, the first block and the second block are made of a second type of material different from the first type of material, and an overall width of the ground portion, the first block, and the radiation portion is 2 mm or less.

The ground portion, the radiation portion, and the director may be made of a conductive material, and the first block and the second block may be made of a dielectric material having a dielectric constant of 3.5 or more to 25 or less.

The ground portion may be configured to reflect the electromagnetic wave radiated by the radiation portion back toward the radiation portion.

The ground portion and the radiation portion may be coupled to opposite sides of the first block, the radiation portion and the director may be coupled to opposite sides of the second block, and a width of the ground block in a direction from the ground portion to the reflector is greater than a width of the radiation portion in the direction from the ground portion to the reflector.

In another general aspect, an antenna module includes a board including a ground region and a feeding region; a chip antenna mounted on a surface of the board, configured to radiate a radiation signal in a first direction, and having a structure in which are sequentially stacked a ground portion having a block shape and electrically connected to the ground region, a first block, a radiation portion having a block shape and electrically connected to the feeding region, a second block, and a director; and a patch antenna disposed in or on the board so that the patch antenna does not overlap the chip antenna in a direction perpendicular to the surface of the board, and configured to radiate a radiation signal in a second direction different from the first direction.

The chip antenna may be mounted on the surface of the board so that the radiation portion of the chip antenna is spaced apart from the ground region by 0.2 mm or more.

The ground portion, the radiation portion, and the director may be made of a conductive material, and the first block and the second block may be made of a dielectric material having a dielectric constant of 3.5 or more to 25 or less.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
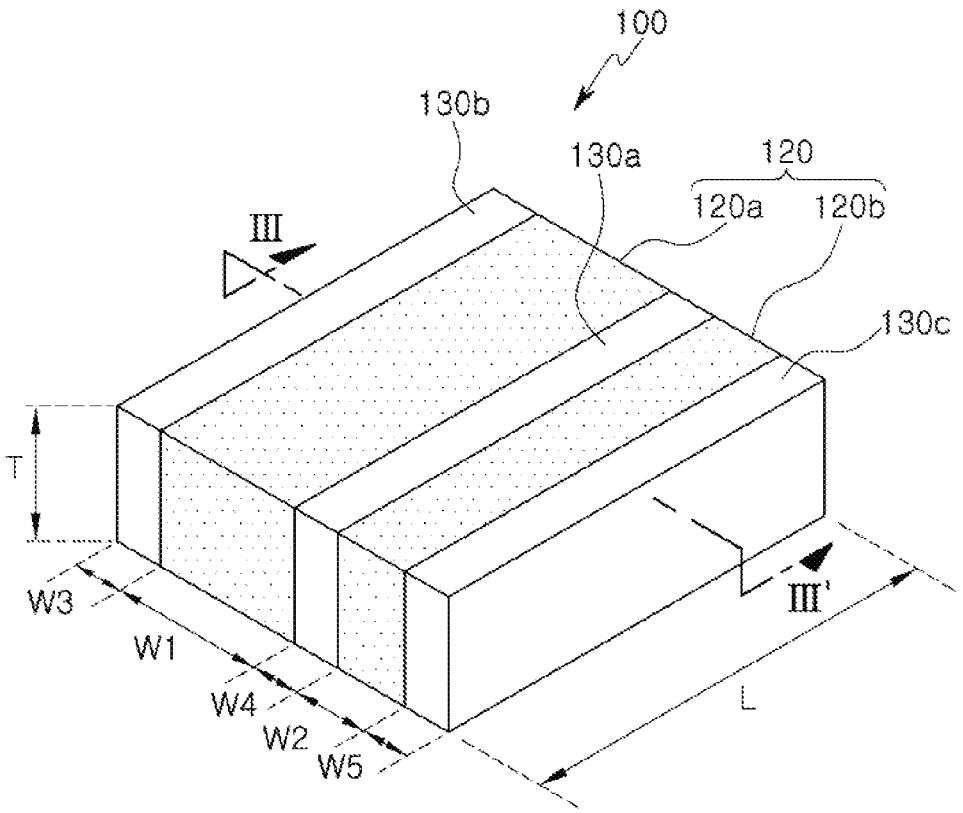
FIG. 1 is a perspective view illustrating an example of a chip antenna.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

A chip antenna module described herein may be operated in a high-frequency band, and may be operated in a millimeter wave communications band. For example, the chip antenna module may be operated in a frequency band between 20 GHz to 60 GHz. In addition, the chip antenna module described herein may be mounted in an electronic device configured to receive or transmit and receive radio signals. For example, a chip antenna may be mounted in a mobile phone, a portable laptop computer, or a drone.

Figure 2:
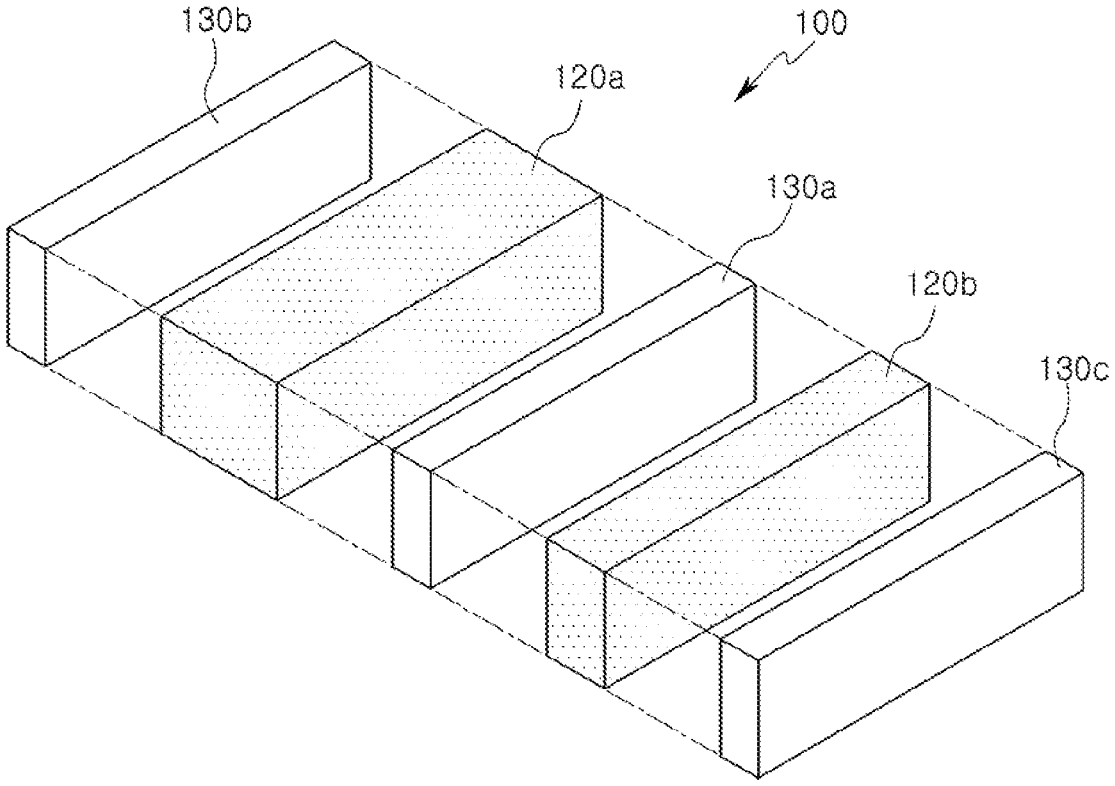
FIG. 2 is an exploded perspective view of the chip antenna illustrated in FIG. 1.
Figure 3:
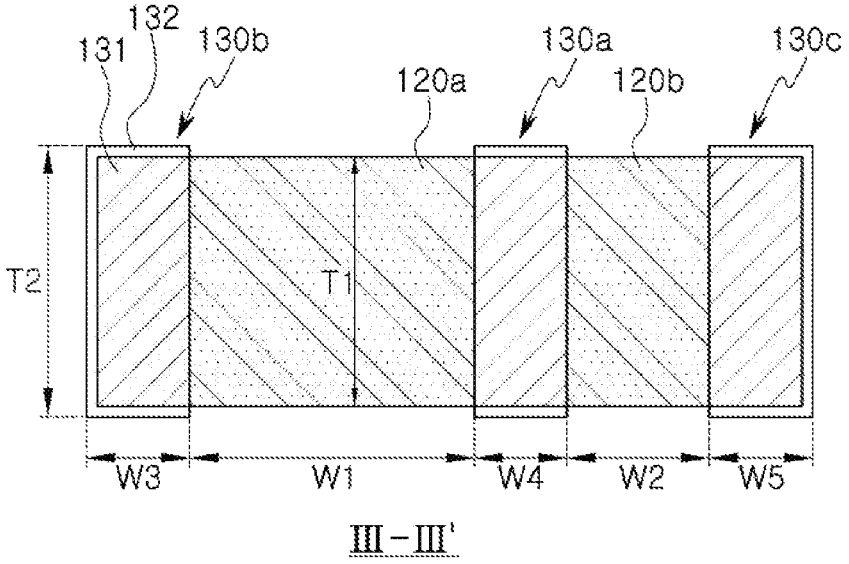
FIG. 3 is a cross-sectional view taken along the line III-III' of FIG. 1.

FIG. 1 is a perspective view illustrating an example of a chip antenna, FIG. 2 is an exploded perspective view of the chip antenna illustrated in FIG. 1, and FIG. 3 is a cross-sectional view taken along the line III-III' of FIG. 1.

An example of a chip antenna will be described with reference to FIGS. 1 through 3.

The chip antenna 100 generally has a hexahedral shape, and is mounted on a board by a conductive adhesive or solder.

The chip antenna 100 includes a body portion 120, a radiation portion 130*a*, a ground portion 130*b*, and a director 130*c*.

The body portion 120 includes a first block 120*a* disposed between the radiation portion 130*a* and the ground portion 130*b*, and a second block 120*b* disposed between the radiation portion 130*a* and the director 130*c*.

Therefore, the chip antenna 100 is configured by sequentially stacking the ground portion 130*b* having conductivity and having a block shape, the first block 120*a* made of a dielectric material, the radiation portion 130*a* having conductivity and having a block shape, the second block 120*b* made of a dielectric material, and the director 130*c* having conductivity and having a block shape.

Both the first block 120*a* and the second block 120*b* have a hexahedral shape, and are made of the dielectric material. For example, the body portion 120 may be made of a polymer or a ceramic sintered body having a dielectric constant.

The chip antenna 100 is used in a millimeter wave communications band. Therefore, an overall width W4+W1+W3 of the radiation portion 130*a*, the first block, and the ground portion 130*b* is 2 mm or less so as to correspond to a wavelength in the millimeter wave communications band. In addition, the chip antenna 100 has a length L selected in a range of 0.5 mm to 2 mm to tune a resonant frequency in the millimeter wave communications band.

When a dielectric constant of the first block 120*a* is less than 3.5, a distance between the radiation portion 130*a* and the ground portion 130*b* needs to be increased for the chip antenna 100 to be normally operated.

As a test result, it was determined that in a case in which the dielectric constant of the first block 120*a* is less than 3.5, the chip antenna 100 performed a normal function in the band of 20 GHz to 60 GHz when the overall width W4+W1+W3 of the radiation portion 130*a*, the first block, and the ground portion 130*b* is 2 mm or more. However, when the chip antenna is configured so that the overall width W4+W1+W3 is greater than 2 mm, an overall size of the chip antenna 100 is increased, making it difficult to mount the chip antenna 100 in a thin portable device.

In addition, when the dielectric constant of the first block 120*a* exceeds 25, the overall width W4+W1+W3 needs to be decreased to 0.3 mm or less. In this case, it was determined that antenna performance was deteriorated.

Therefore, to maintain the antenna performance at an acceptable level while allowing the overall width W4+W1+W3 to be 2 mm or less, in this example, the first block 120*a* is made of a dielectric material having a dielectric constant of 3.5 or more to 25 or less.

The second block 120*b* is made of the same material as the first block 120*a*. A width W2 of the second block 120*a* is 50 to 60% of a width W1 of the first block 120*a*. In addition, a length L and a thickness T of the second block 120*b* are the same as those of the first block.

Therefore, the second block 120*b* is made of the same material as the first block 120*a* and has the same length and thickness as the first block 120*a*, and has a width different from that of the first block 120*a*.

However, the second block 120*b* is not limited thereto, but may also be made of a material different from that of the first block 120*a* if desired. The second block 120*b* may be made of a material having a dielectric constant different from that of a material of the first block 120*a* if desired. For example, the second block 120*b* may be made of a material having a dielectric constant higher than that of the material of the first block 120*a*.

The radiation portion 130*a* has a first surface coupled to a first surface of the first block 120*a*. In addition, the ground portion 130*b* is coupled to a second surface of the first block 120*a*. The first surface and the second surface are opposite surfaces of the first block 120*a* having the hexahedral shape.

In addition, a second surface of the radiation portion 130*a* is coupled to a first surface of the second block 120*b*, and the director 130*c* is coupled to a second surface of the second block 120*b*. The first surface and the second surface of the second block 120*b* are opposite surfaces of the second block 120*b* having the hexahedral shape.

In this example, the width W1 of the first block 120*a* is a distance between the first surface and the second surface of the first block 120*a*. In addition, the width W2 of the second block 120*b* is a distance between the first surface and the second surface of the second block 120*b*. Therefore, a direction from the first surface toward the second surface (or a direction from the second surface toward the first surface) is a width direction of the first block 120*a* or the chip antenna 100.

In addition, widths W3 and W4 of the ground portion 130*b* and the radiation portion 130*a* and a width W5 of the director 130*c* are distances in the width direction of the chip antenna 100 described above. Therefore, the width W4 of the radiation portion 130*a* is the shortest distance from a bonded surface of the radiation portion 130*a* bonded to the first surface of the first block 120*a* to a bonded surface of the radiation portion 130*a* bonded to the second block 120*b*, and the width W3 of the ground portion 130*b* is the shortest distance from a bonded surface (a first surface) of the ground portion 130*b* bonded to the second surface of the first block 120*a* to an opposite surface (a second surface) of the ground portion 130*b* opposite to the bonded surface (the first surface) of the ground portion 130*b*.

In addition, the width W5 of the director 130*c* is the shortest distance from a bonded surface of the director 130*c* bonded to the second block 120*b* to an opposite surface of the director 130*c* opposite to the bonded surface of the director 130*c*.

The radiation portion 130*a* is in contact with only one of six surfaces of the first block 120*a*, and is coupled to the first block 120*a*. Likewise, the ground portion 130*b* is in contact with one of the six surfaces of the first block 120*a*, and is coupled to the first block 120*a*.

As described above, the radiation portion 130*a* and the ground portion 130*b* are not disposed on surfaces of the first block 120*a* other than the first surface and the second surface of the first block 120*a*, and are disposed in parallel with each other with the first block 120*a* interposed therebetween.

When the radiation portion 130*a* and the ground portion 130*b* are only coupled to the first surface and the second surface of the first block 120*a*, respectively, the chip antenna has a capacitance due to a dielectric material (the first block 120*a*) between the radiation portion 130*a* and the ground portion 130*b*. Therefore, a coupling antenna may be designed or a resonant frequency may be tuned using the dielectric material.

The director 130*c* has the same size as the radiation portion 130*a*, is in contact with only one of six surfaces (the second surface) of the second block 120*b*, and is coupled to the second block 120*b*.

Therefore, the director 130*c* is spaced apart from the radiation portion 130*a* by the second block 120*b*, and is disposed in parallel with the radiation portion 130*a*.

As described above, the width W2 of the second block 120*b* is smaller than the width W1 of the first block 120*a*, and thus the radiation portion 130*a* is closer to the director 130*c* than the ground portion 130*b*.

Figure 4A:
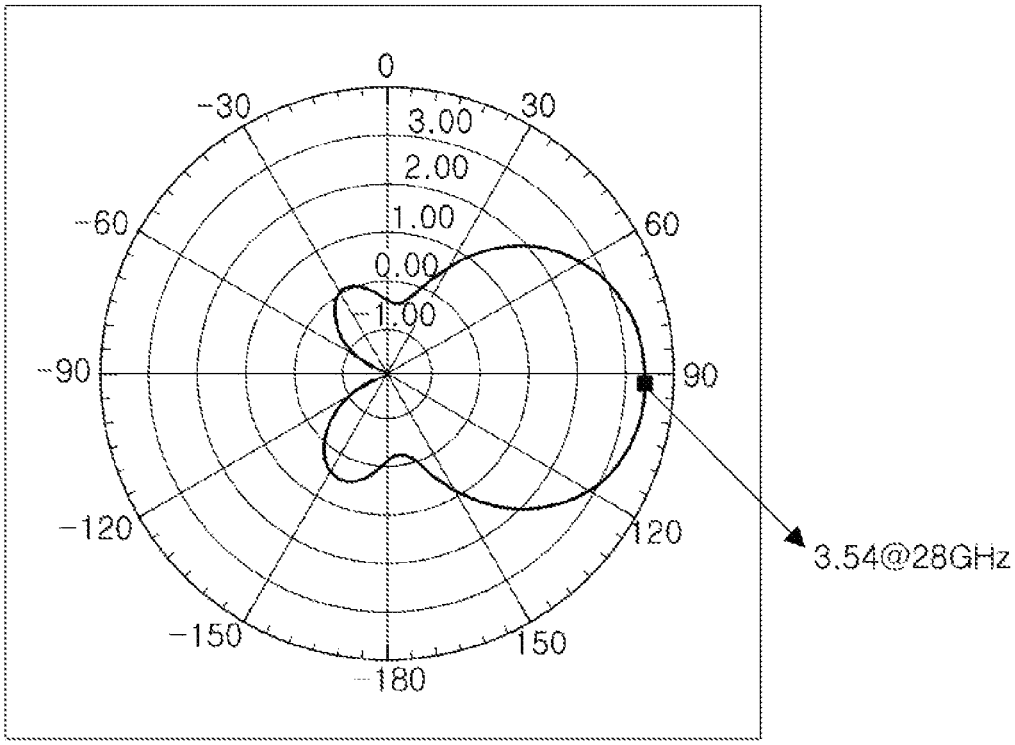
FIGS. 4A and 4B are graphs illustrating measurement results of radiation patterns of chip antennas.
Figure 4B:
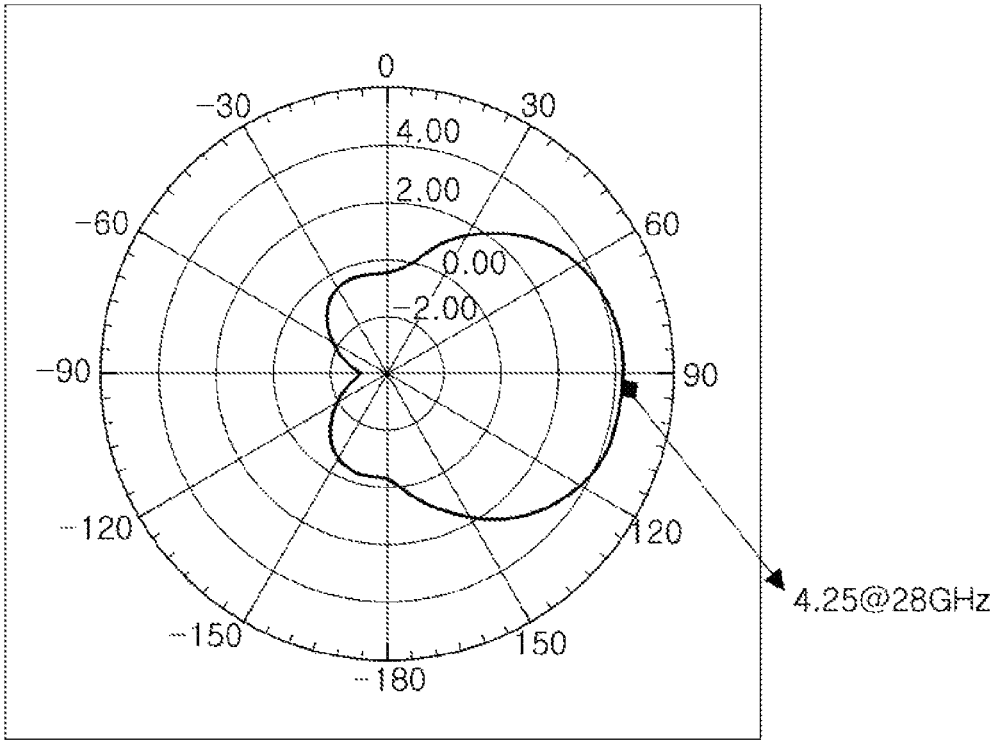

FIGS. 4A and 4B are graphs illustrating measurement results of radiation patterns of chip antennas, wherein FIG. 4A is a graph illustrating a measurement result of a radiation pattern of a chip antenna in which the second block 120*b* and the director 130*c* are omitted, and FIG. 4B is a graph illustrating a measurement result of a radiation pattern of the chip antenna 100 including the second block 120*b* and the director 130*c* and illustrated in FIG. 1.

The chip antenna used in the present measurement was configured so that the widths W4, W3, and W5 of the radiation portion 130*a*, the ground portion 130*b*, and the director 130*c* are each 0.2 mm, the width W1 of the first block 120*a* is 0.6 mm, the width W2 of the second block 120*b* is 0.3 mm, and a thickness T is 0.5 mm.

Referring to FIG. 4A, the chip antenna that does not include the director 130*c* has a gain of 3.54 dBi at 28 GHz, and referring to FIG. 4B, the chip antenna 100 that includes the director 130*c* has a gain of 4.25 dBi at 28 GHz. Therefore, it was confirmed that a gain is improved in the chip antenna 100 of this example.

Therefore, it may be appreciated that the radiation efficiency is significantly improved when the chip antenna 100 includes the director 130*c* as in this example.

In the chip antenna 100 of this example, it was determined that as the widths W4 and W3 of the radiation portion 130*a* and the ground portion 130*b* are increased, a reflection loss S11 was decreased. In addition, it was determined that the reflection loss S11 is decreased at a high decrease rate when the widths W4 and W3 of the radiation portion 130*a* and the ground portion 130*b* are 100 μm or less, and is decreased at a relatively low decrease rate when the widths W4 and W3 of the radiation portion 130*a* and the ground portion 130*b* exceed 100 μm.

Therefore, in this example, each of the width W4 of the radiation portion 130*a* and the width W3 of the ground portion 130*b* are defined to be 100 μm or more.

In addition, when the widths W4 and W3 of the radiation portion 130*a* and the ground portion 130*b* are greater than the width W1 of the first block 120*a*, the radiation portion 130*a* and the ground portion 130*b* may be separated from the body portion 120 by an external impact or when mounting the chip antenna 100 on the board. Therefore, in this example, maximum widths W4 and W3 of the radiation portion 130*a* and the ground portion 130*b* are defined to be 50% or less of the width W1 of the first block 120*a*.

To mount the chip antenna in the thin portable device, the overall width W4+W1+W3 of the radiation portion 130*a*, the first block 120*a*, and the ground portion 130*b* needs to be 2 mm or less as described above. Therefore, in this example, when the radiation portion 130*a* and the ground portion 130*b* have the same width, maximum widths of the radiation portion 130*a* and the ground portion 130*b* are defined to be approximately 500 μm and minimum widths of the radiation portion 130*a* and the ground portion 130*b* are defined to be approximately 100 μm. However, the widths of the radiation portion 130*a* and the ground portion 130*b* are not limited thereto, and when the widths of the radiation portion 130*a* and the ground portion 130*b* are different from each other, the maximum widths of the radiation portion 130*a* and the ground portion 130*b* described above may be changed.

In the chip antenna 100 of this example, when the length L of the chip antenna 100 is increased, the reflection loss S11 is decreased, and a resonant frequency is decreased. Therefore, the length L of the chip antenna may be adjusted to optimize the resonant frequency or decrease the reflection loss S11.

All of the radiation portion 130*a*, the ground portion 130*b*, and the director 130*c* are made of the same material.

As illustrated in FIG. 3, each of the radiation portion 130*a*, the ground portion 130*b*, and the director 130*c* include a first conductor 131 and a second conductor 132.

The first conductor 131 is a conductor directly bonded to the first block 120*a* and the second block 120*b*, and has a block shape. In addition, the second conductor 132 is formed as a layer on a surface of the first conductor 131.

The first conductor 131 is formed on the first block 120*a* or the second block 120*b* by a printing process or a plating process, and may be made of a metal selected from Ag, Au, Cu, Al, Pt, Ti, Mo, Ni, and W, or an alloy of two or more metals selected from Ag, Au, Cu, Al, Pt, Ti, Mo, Ni, and W. Alternatively, the first conductor 131 may also be made of a conductive paste or a conductive epoxy in which an organic material such as a polymer or a glass is contained in a metal.

The second conductor 132 is formed on the surface of the first conductor 131 by a plating process. The second conductor 132 may be formed by sequentially stacking a nickel (Ni) layer and a tin (Sn) layer or sequentially stacking a zinc (Zn) layer and a tin (Sn) layer, but is not limited thereto.

The first conductor 131 is formed to have the same thickness and height as those of each of the first block 120*a* and the second block 120*b*. Therefore, as illustrated in FIG. 3, each of the radiation portion 130*a*, the ground portion 130*b*, and the director 130*c* have a thickness T2 greater than a thickness T1 of the first block 120*a* due to the second conductor 132 formed as a layer on the surface of the first conductor 131.

The chip antenna 100 configured as described above may be used in a high frequency band of 20 GHz or more to 60 GHz or less, and the overall width W4+W1+W3 of the radiation portion 130*a*, the first block 120*a*, and the ground portion 130*b* and the overall length are 2 mm or less so that the chip antenna 100 may be easily mounted in the thin portable device.

In addition, since the radiation portion 130*a* and the ground portion 130*b* are in contact with only the first and second surface of the first block 120*a*, respectively, the resonant frequency may be easily tuned.

In addition, the chip antenna 100 includes the director 130*c*, and the ground portion 130*b* functions as a reflector. Therefore, a rectilinear propagation property of a beam and gain are improved so that a radiation efficiency is improved.

Although not illustrated, bonding portions may be interposed between the dielectric materials and the conductors. The bonding portions may be disposed between the first block 120*a* and the radiation portion 130*a* and between the first block 120*a* and the ground portion 130*b*. In addition, the bonding portions may be disposed between the second block 120*b* and the radiation portion 120*a* and between the second block 120*b* and the director 120*c*.

The bonding portions bond the first conductor 131 and the body portion 120 to each other. Therefore, the radiation portion 130*a*, the ground portion 130*b*, and the director 130*c* are bonded to the body portion 120 through the bonding portions.

The bonding portions are provided to firmly couple the radiation portion 130*a*, the ground portion 130*b*, and the director 130*c* to the body portion 120. Therefore, the bonding portion are made of a material that may be easily bonded to the first conductors 131 of the radiation portion 130*a*, the ground portion 130*b*, the director 130*c*, and the body portion 120.

For example, the bonding portion may be made of any one or any combination of any two or more of Cu, Ti, Pt, Mo, W, Fe, Ag, Au, and Cr. Alternatively, the bonding portion may be made of any one or any two or more of a silver (Ag) paste, a copper (Cu) paste, a silver-copper (Ag—Cu) paste, a nickel (Ni) paste, and a solder paste.

Alternatively, the bonding portion may be made of a material such as an organic chemical material, a glass, $SiO_2$, graphene, or graphene oxide.

The bonding portion may have one layer, and may have a thickness of, for example, 10 μm to 50 μm. However, the bonding portion is not limited thereto, but may be modified in various ways. For example, the bonding portion may be made by stacking a plurality of layers.

However, the chip antenna 100 is not limited to the abovementioned configuration, but may be modified in various ways.

FIGS. 5 through 9 are perspective views illustrating other examples of a chip antenna.

Figure 5:
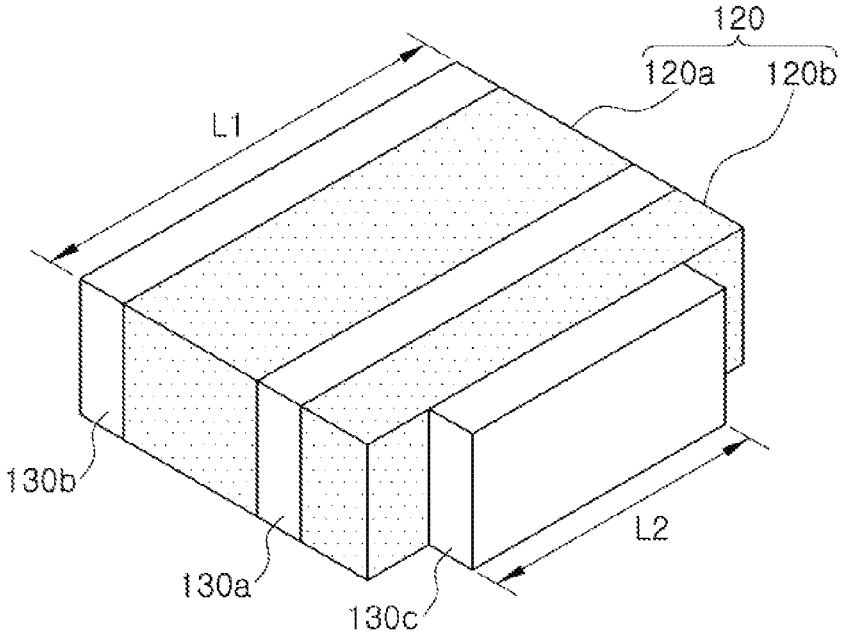
FIGS. 5 through 9 are perspective views illustrating other examples of a chip antenna.

In a chip antenna illustrated in FIG. 5, the director 130*c* has a length L2 smaller than a length L1 of the radiation portion 130*a*. For example, the length L2 of the director 130*c* may be 5% smaller than the length L1 of the radiation portion 130*a*, but is not limited thereto.

In this example, the center of the director 130*c* is disposed in a straight line with the center of the radiation portion 130*a*.

Figure 6:
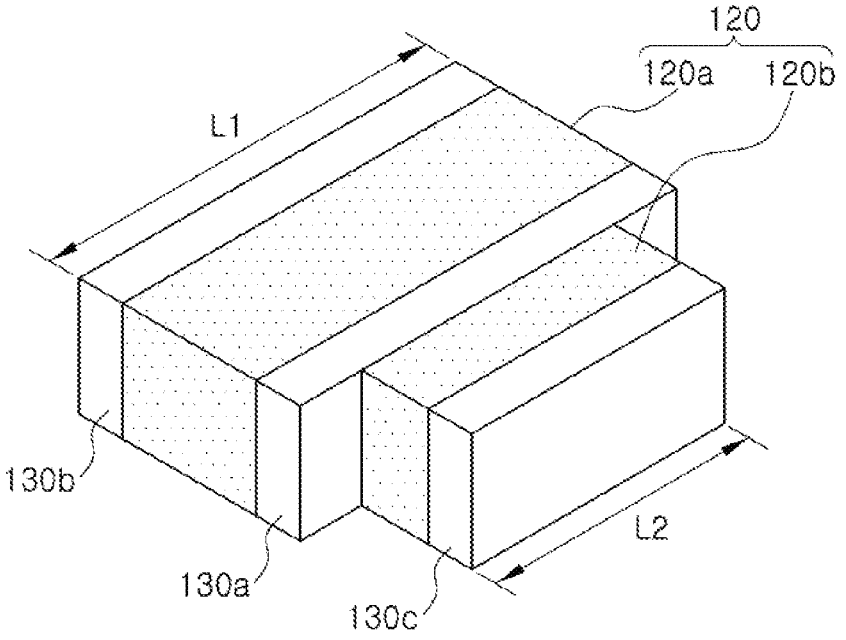

In a chip antenna illustrated in FIG. 6, the second block 120*b* as well as the director 130*c* have a length L2 smaller than the length L1 of the radiation portion 130*a*. In this example, the second block 120*b* has the same length L2 as that of the director 130*c*. Therefore, the length L2 of the director 130*c* and the second block 120*b* may be 5% smaller than the length L1 of the radiation portion 130*a*. However, the director 130*c* and the second block 120*b* are not limited thereto, but may be modified in various ways. For example, the second block 120*b* may have a length greater or smaller than the length L2 of the director 130*c*.

Figure 7:
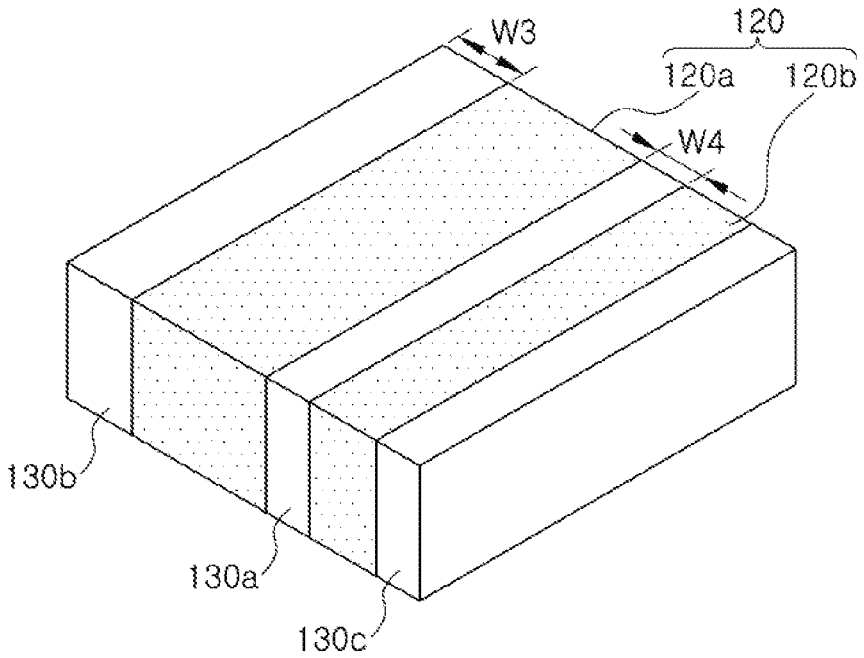

In a chip antenna illustrated in FIG. 7, the ground portion 130*b* has a width W3 greater than a width W4 of the radiation portion 130*a*. Since the ground portion 130*b* functions as a reflector, a length extension effect may be achieved by increasing the width W3 of the ground portion 130*b*.

The chip antenna of this example has a structure similar to that of a Yagi-Uda antenna. Therefore, like the Yagi-Uda antenna, the radiation portion 130*a* functioning as a radiator radiates an electromagnetic wave toward the director 130*c*, and the director 130*c* radiates an electromagnetic wave induced by the electromagnetic wave radiated by the radiation portion 130*a*. In this case, wavelengths of the electromagnetic waves radiated by the radiation portion 130*a* and the director 130*c* generate constructive interference due to a phase difference to increase a gain of the chip antenna. In addition, the radiator 130*a* radiates an electromagnetic wave toward the ground portion 130*b* functioning as a reflector, which reflects the electromagnetic wave toward the director 130*c* o improve a radiation efficiency of the chip antenna.

In a general Yagi-Uda antenna, the reflector has a length greater than that of the radiator. However, in the chip antenna of this example, the ground portion 130*b* has a width W3 greater than a width W4 of the radiation portion 130*a* due to a limitation on a size of the chip antenna. For example, the width W3 of the ground portion 130*b* may be 150% of the width W4 of the radiation portion 130*a*, but is not limited thereto.

Figure 8:
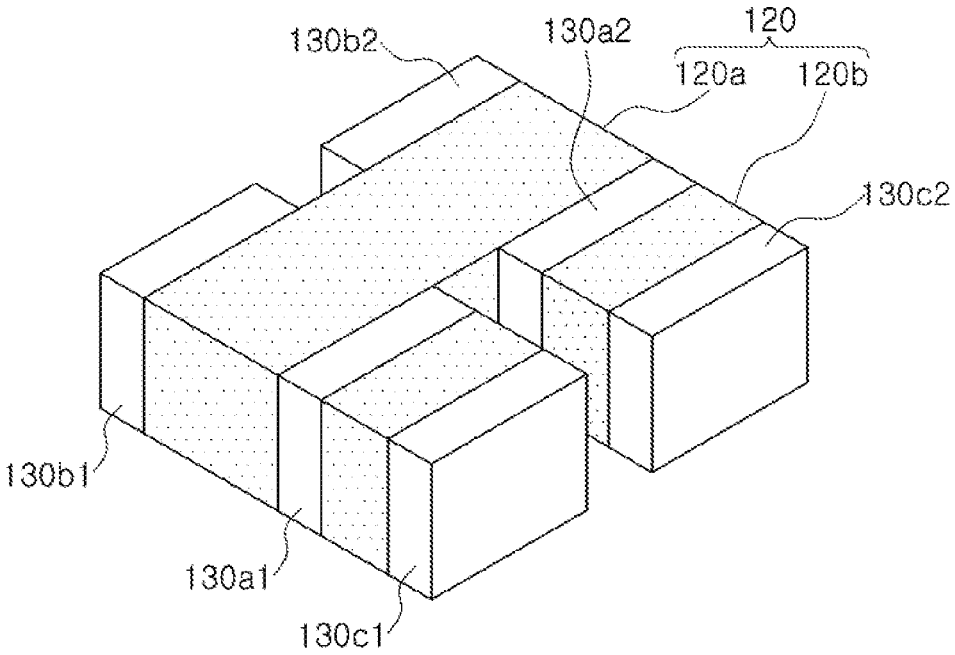

In a chip antenna illustrated in FIG. 8, the ground portion includes a first ground portion 130*b*1 and a second ground portion 130*b*2 spaced apart from each other. In addition, the radiation portion includes a first radiation portion 130*a*1 and a second radiation portion 130*a*2 spaced apart from each other, and the director includes a first director 130*c*1 and a second director 130*c*2 spaced apart from each other.

All of the first ground portion 130*b*1, the first radiation portion 130*a*1, and the first director 130*c*1 are disposed in a straight line. Likewise, all of the second ground portion 130*b*2, the second radiation portion 130*a*2, and the second director 130*c*2 are disposed in a straight line.

In the chip antenna of this example, a dipole antenna structure is implemented in one chip antenna.

Figure 10:
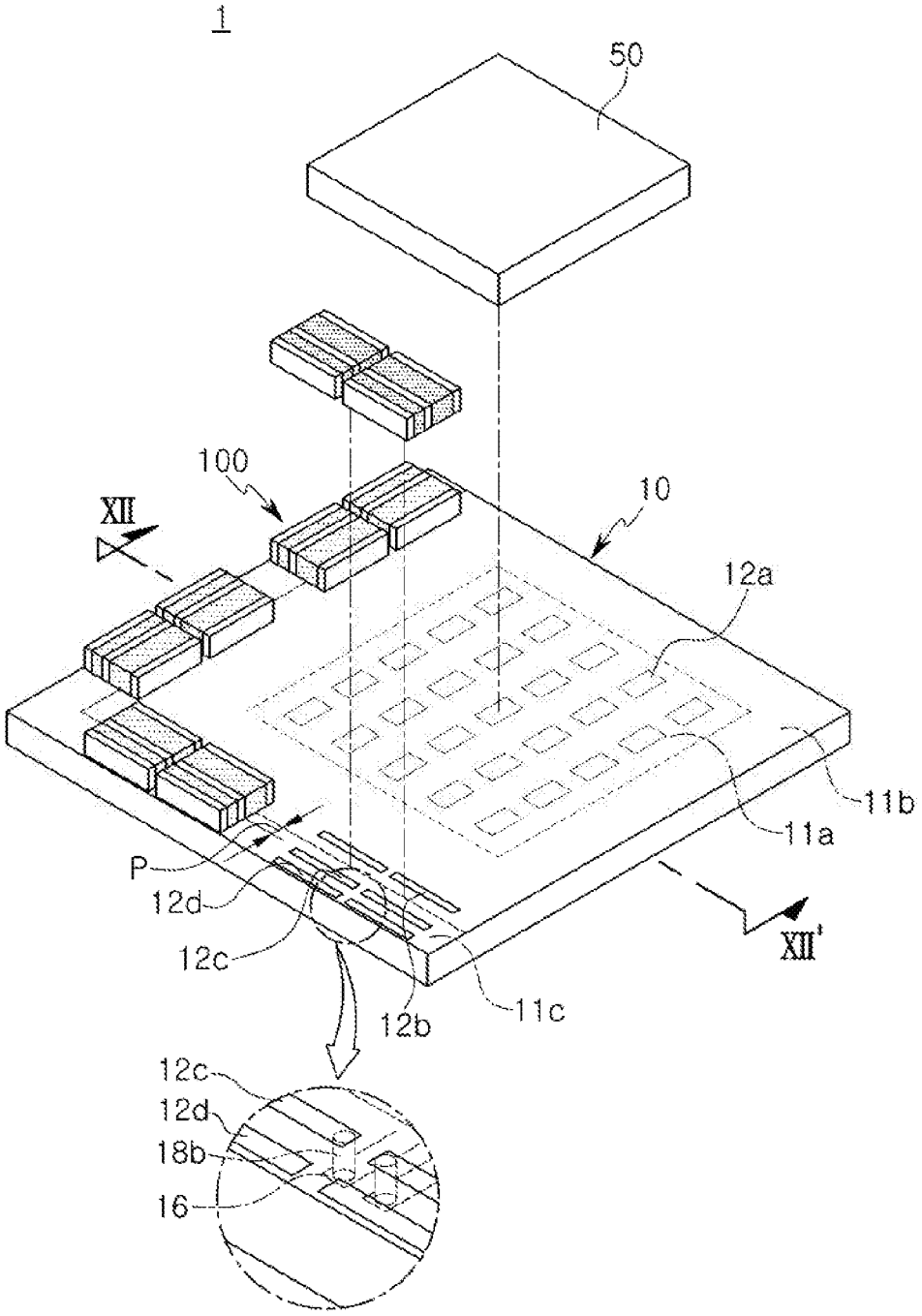
FIG. 10 is a partially exploded perspective view of an example of a chip antenna module including the chip antenna illustrated in FIG. 1.

Therefore, only one chip antenna rather than two chip antennas may be used to configure a dipole antenna structure as illustrated in FIG. 10.

In this example, the first block 120*a* is a single body, but the second block 120*b* is divided into two portions, one of which is disposed between the first radiation portion 130*a*1 and the first director 130*c*1, and the other of which is disposed between the second radiation portion 130*a*2 and the second director 130*c*2. However, a configuration of the chip antenna of this example is not limited thereto, but may be modified in various ways. For example, the second block 120*b* may be a single body as is a second block 120*b* to be described with reference to FIG. 9.

In addition, like in the examples illustrated in FIGS. 5 and 6, the first director 130*c*1 and the second director 130*c*2 may have lengths smaller than lengths of the first radiation portion 130*a*1 and the second radiation portion 130*a*2.

Figure 9:
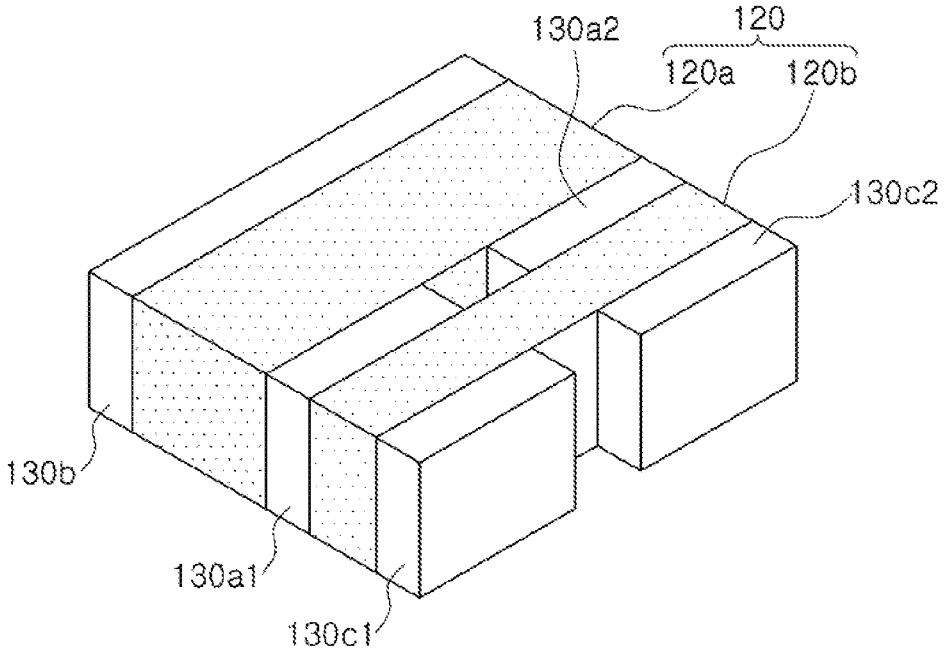

In a chip antenna illustrated in FIG. 9, the radiation portion includes a first radiation portion 130*a*1 and a second radiation portion 130*a*2 spaced apart from each other, and the director includes a first director 130*c*1 and a second director 130*c*2 spaced apart from each other. In addition, the ground portion 130*b* is a single body.

In addition, the first block 120*a* is a single body and is disposed between the radiation portions 130*a*1 and 130*a*2 and the ground portion 130*b*, and the second block 120*b* is also a single body and is disposed between the radiation portions 130*a*1 and 130*a*2 and the directors 130*c*1 and 130*c*2.

In the chip antenna of this example, the ground portion 130*b* has a length greater than lengths of the radiation portion 130*a*1 and 130*a*2, and reflection efficiency of an electromagnetic wave is thus improved.

Meanwhile, like in the examples illustrated in FIGS. 5 and 6, the first director 130*c*1 and the second director 130*c*2 may have lengths smaller than lengths of the first radiation portion 130*a*1 and the second radiation portion 130*a*2.

Figure 11:
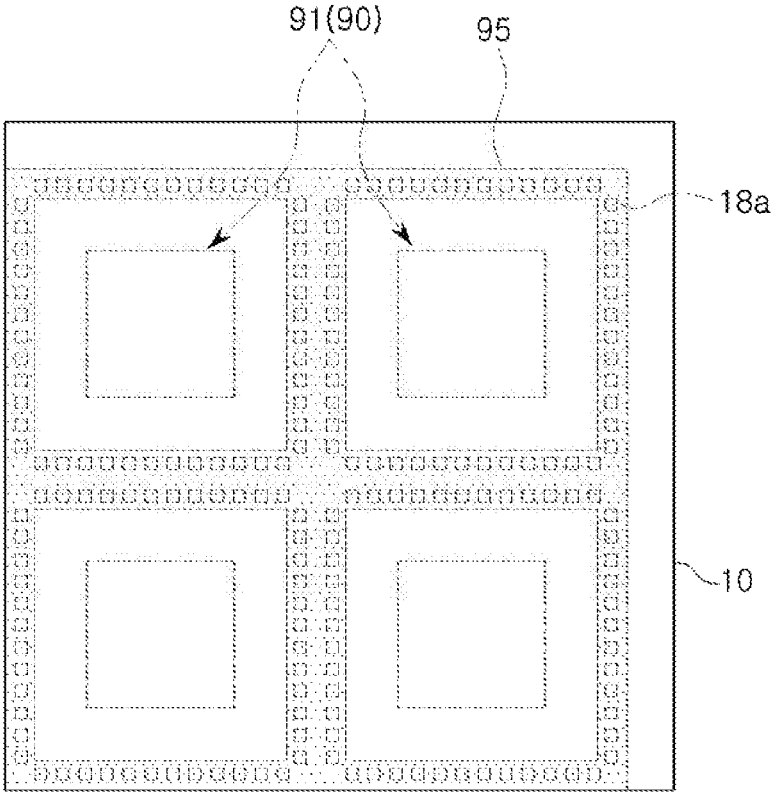
FIG. 11 is a bottom view of the chip antenna illustrated in FIG. 10.
Figure 12:
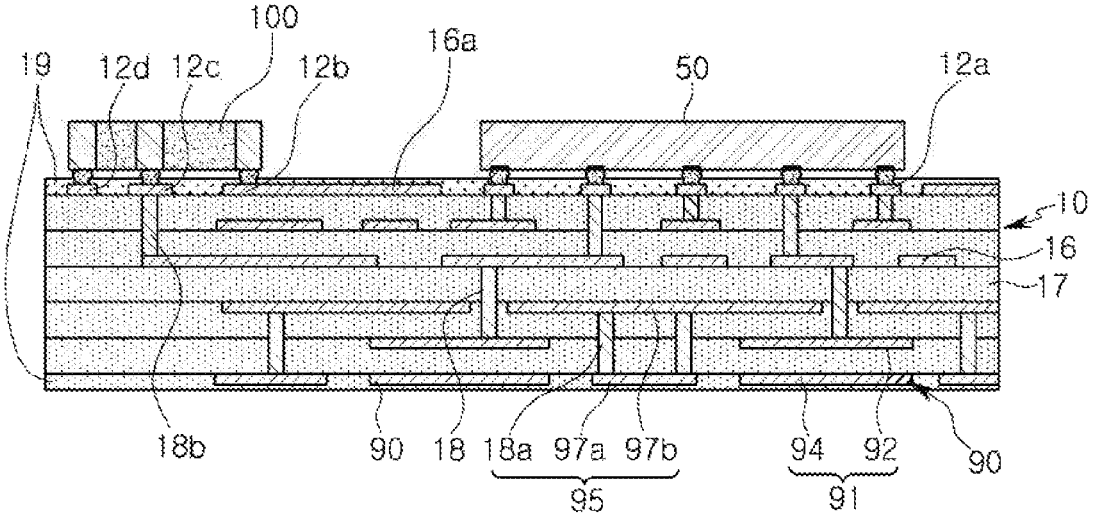
FIG. 12 is a cross-sectional view taken along the line XII-XII' of FIG. 10.

FIG. 10 is a partially exploded perspective view of an example of a chip antenna module including the chip antenna illustrated in FIG. 1, FIG. 11 is a bottom view of the chip antenna illustrated in FIG. 10, and FIG. 12 is a cross-sectional view taken along the line XII-XII' of FIG. 10.

Referring to FIGS. 10 through 12, a chip antenna module 1 includes a board 10, an electronic element 50, and chip antennas 100.

The board 10 is a circuit board on which circuits or electronic components for a radio antenna are mounted. For example, the board 10 may be a printed circuit board (PCB) containing one or more electronic components therein or having one or more electronic components mounted on a surface thereof. Therefore, the board 10 may be provided with circuit wirings electrically connecting the electronic components to each other.

The board 10 may be a multilayer board formed by repeatedly stacking a plurality of insulating layers 17 and a plurality of wiring layers 16 (see FIG. 12). However, if desired, a double-sided board on which wiring layers are formed on opposite surfaces of one insulating layer may also be used.

Various kinds of boards (for example, a printed circuit board, a flexible board, a ceramic board, or a glass board) may be used as the board 10.

A first surface of the board 10, which is an upper surface of the board 10 in the example illustrated in FIGS. 10 through 12, is divided into an element mounting portion 11*a*, a ground region 11*b*, and a feeding region 11*c*.

The element mounting portion 11*a*, which is a region on which the electronic element 50 is mounted, is disposed inside a ground region 11*b* to be described below. A plurality of connection pads 12*a* to which the electronic element 50 is electrically connected are disposed in the element mounting portion 11*a*.

The ground region 11*b*, which is a region on which a ground layer 16*a* (see FIG. 12) is disposed, is disposed surrounding the element mounting portion 11*a*. In this example, the element mounting portion 11*a* has a rectangular shape. Therefore, the ground region 11*b* has a rectangular ring shape so as to surround the element mounting portion 11*a*.

Since the ground region 11*b* is disposed along an entire circumference of the element mounting portion 11*a*, the connection pads 12*a* of the element mounting portion 11*a* may be electrically connected to an external device or other components through interlayer connection conductors 18 (see FIG. 12) penetrating through the insulating layers 17 of the board 10.

A plurality of ground pads 12*b* are formed in the ground region 11*b*. When the ground layer is formed from the uppermost wiring layer 16 of the board 10, like the ground layer 16*a* in FIG. 12, the ground pads 12*b* may be formed by partially opening an insulation protective layer 19 (see FIG. 12) covering the ground layer. However, the ground pads are not limited thereto, and when the ground layer is not formed from the uppermost wiring layer 16 of the board 10, but is disposed between other wiring layers 16, the ground pads 12*b* may be formed from the uppermost wiring layer 16, and the ground pads 12*b* and the ground layer may be connected to each other through interlayer connection conductors (not illustrated, but like interlayer connection conductors 18).

The ground pads 12*b* are disposed in pairs with feed pads 12*c* to be described below. Therefore, the ground pads 12*b* are disposed adjacent to the feed pads 12*c*.

The feeding region 11*c* is disposed outside the ground region 11*b*. In this example, the feeding region 11*c* is a region outside two sides of the ground region 11*b*. Therefore, the feeding region 11*c* is disposed along two edges of the board 10. However, a configuration of the feeding region 11*c* is not limited thereto.

A plurality of feed pads 12*c* and a plurality of dummy pads 12*d* are disposed in the feeding region 11*c*. The feed pads 12*c* are disposed on the uppermost wiring layer, like the connection pads 12*a*, and may be electrically connected to the electronic element 50 or other components through interlayer connection conductors penetrating through the insulating layers of the board 10.

In this example, the feed pads 12*c* are disposed in pairs. Referring to FIG. 10, a total of four pairs of feed pads 12*c* are disposed. However, a configuration of the feed pads 12*c* is not limited thereto, and the number of pairs of feed pads 12*c* may be changed depending on a size of the chip antenna module or other factors.

In addition, in this example, the feed pad 12*c* has a length that is the same or substantially the same as a length of a lower surface (or a bonded surface) of the radiation portion 130*a*. In addition, an area of the feed pad 12*c* may be in a range of 80% to 120% of an area of the lower surface of the radiation portion 130*a* of the chip antenna 100. However, the feed pads are not limited thereto.

In this example, two feed pads 12*c* disposed in a pair are linear strips, and are spaced apart from each other on a straight line so that end portions thereof face each other.

When the area of the feed pad 12*c* is substantially the same as the area of the lower surface of the radiation portion 130*a* of the chip antenna 100 as described above, a bonding reliability between the chip antenna 100 and the board 10 is improved.

In addition, in this example, interlayer connection conductors 18*b* (hereinafter referred to as feed vias) connected to the feed pads 12*c* are disposed at end portions of the feed pads 12*c*. The feed vias 18*b* extend into the board 10 in a direction perpendicular to the feed pads 12*c*, and are connected to the wiring layers in the board 10.

As described above, the two feed pads 12*c* are disposed in a pair. Therefore, two feed vias 18*b* connected to the feed pads 12*c* are also disposed in a pair.

The two feed vias 18*b* disposed in a pair are disposed at end portions of the two feed pads 12*c* disposed in a pair at which the two feed pads 12*c* disposed in a pair face each other, and are parallel to each other. The feed vias 18*b* are disposed adjacent to each other. For example, the two feed vias 18*b* may be spaced apart from each other by 0.5 mm or less. In addition, a distance between the two feed vias 18*b* may be the same or substantially the same as a distance between the two feed pads 12*c* disposed in a pair.

The plurality of dummy pads 12*d* are disposed on the uppermost wiring layer, like the feed pads 12*c*. However, the dummy pads 12*d* are not electrically connected to other components of the board, and are bonded to the directors 130*c* of the chip antennas 100 mounted on the board.

The dummy pads 12*d* are not provided to electrically connect the directors 130*c* and the circuits in the board 10 to each other, but are provided to more firmly bond the chip antennas 100 to the board 10. Therefore, the dummy pads 12*d* may be omitted if the chip antennas 100 can be firmly fixed to the board 10 by only the feed pads 12*c* and the ground pads 12*b*. In this case, the directors 130*c* will be in contact with the board 10, but will not be electrically connected to the board 10.

The element mounting portion 11*a*, the ground region 11*b*, and the feeding region 11*c* configured as described above are divided depending on a shape or a position of the ground layer 16*a* disposed thereon, and are protected by the insulation protective layer 19 in FIG. 12 stacked and disposed on the uppermost wiring layer and uppermost insulating layer. In addition, the connection pads 12*a*, the ground pads 12*b*, the feed pads 12*c*, and the dummy pads 12*d* are externally exposed in pad form through openings formed by removing portions of the insulation protective layer 19.

A configuration of the feed pad 12*c* is not limited to the abovementioned configuration, but may be modified in various ways. For example, an area of the feed pad 12*c* may be half or less of an area of the lower surface (or the bonded surface) of the radiation portion 130*a* of the chip antenna 100. In this case, the feed pad 12*c* may have a circular shape rather than linear strip shape, and is not bonded to the entirety of the lower surface of the radiation portion 130*a*, but is bonded to only a portion of the lower surface of the radiation portion 130*a*.

A patch antenna 90 is disposed in the board 10 or on a second surface, which is a lower surface, of the board 10.

In this example, patch antenna 90 is formed from a wiring layer 16 provided on the second or lower surface of the board 10. However, the patch antenna is not limited thereto.

As illustrated in FIGS. 11 and 12, the patch antenna 90 includes a feeding portion 91 including a feeding electrode 92 and a non-feeding electrode 94.

In this example, the patch antenna 90 has a plurality of feeding portions 91 distributed and arranged on the second surface of the board 10. In this example, the number of feeding portions 91 may be four, but is not limited thereto.

In this example, the patch antenna 90 is configured so that portions thereof (for example, the non-feeding electrode 94) are disposed on the second surface of the board 10. However, the patch antenna 90 is not limited thereto, but may be modified in various ways. For example, the entirety of the patch antenna 90 may be disposed in the board 10.

The feeding electrode 92 is made of a metal layer having a flat shape with a predetermined area, and is made of one conductor plate. The feeding electrode 92 may have a polygonal shape, and has a rectangular shape in this example, but may be modified in various ways. For example, the feeding electrode 92 may have a circular shape.

The feeding electrode 92 is connected to the electronic element 50 through the interlayer connection conductors 18. In this example, the interlayer connection conductors 18 penetrate through a second ground layer 97*b* to be described below and are connected to the electronic element 50.

The non-feeding electrode (or parasitic electrode) 94 is spaced apart from the feeding electrode 91 by a predetermined distance, and is made of one flat conductor plate having a predetermined area. The non-feeding electrode 94 has an area that is the same or substantially the same as an area of the feeding electrode 92. For example, the non-feeding electrode 94 may have an area greater than the area of the feeding electrode 92 so that the non-feeding electrode 94 may be disposed to face the entirety of the feeding electrode 92.

The non-feeding electrode 94 is disposed adjacent to a surface of the board 10 as compared to the feeding electrode 92 so that the non-feeding electrode 94 may function as a director. Therefore, the non-feeding electrode 94 is disposed on the lowermost wiring layer 16 of the board 10. In this example, the non-feeding electrode 94 is protected by an insulation protective layer 19 disposed on a lower surface of the lowermost wiring layer 16 and a lowermost insulating layer 17 of the board 10.

In addition, the board 10 includes a ground structure 95. The ground structure 95 is disposed in the vicinity of the feeding portion 91 and is configured in a container shape containing the feeding portion 91 therein as be seen in FIG. 11. To this end, the ground structure 95 includes a first ground layer 97*a*, a second ground layer 97*b*, and ground vias 18*a*.

Referring to FIG. 12, the first ground layer 97*a* is coplanar with the non-feeding electrode 94, and is disposed in the vicinity of the non-feeding electrode 94 so as to surround the non-feeding electrode 94. In this example, the first ground layer 97*a* is spaced apart from the non-feeding electrode 94 by a predetermined distance.

The second ground layer 97*b* is disposed on a wiring layer 16 different from a wiring layer 16 on which the first ground layer 97*a* is disposed. For example, the second ground layer 97*b* may be disposed between the feeding electrode 92 and the first (uppermost) surface of the board 10. In this example, the feeding electrode 92 is disposed between the non-feeding electrode 94 and the second ground layer 97*b*.

The second ground layer 97*b* is entirely disposed on the corresponding wiring layer 16, and is partially removed only at a portion at which the interlayer connection conductor 18 connected to the feeding electrode 92 is disposed.

The ground vias 18*a* are interlayer connection conductors electrically connecting the first ground layer 97*a* and the second ground layer 97*b* to each other, and a plurality of ground vias 18*a* are arranged along a circumference of the feeding portion 91 so as to surround the feeding portion 91. Although an example in which the ground vias 18*a* are arranged in a row has been described, the ground vias 18*a* may be modified in various ways. For example, the ground vias 18*a* may be arranged in a plurality of rows if desired.

Due to the configuration described above, the feeding portion 91 is disposed in the ground structure 95 formed in the container shape by the first ground layer 97*a*, the second ground layer 97*b*, and the ground vias 18*a*. In this example, the plurality of ground vias 18*a* arranged in a row delimit side surfaces of the container shape described above.

In this example, each of the feeding portions 91 is disposed in the container shape. Therefore, interference between the respective feeding portions 91 is blocked by the ground structure 95. For example, noise transferred in a horizontal direction of the board 10 is blocked by the side surfaces of the container shape formed by the plurality of ground vias 18*a*.

The ground vias 18*a* form the side surfaces of the container shape, and isolate the feeding portion 91 from other feeding portions 91 adjacent thereto. In addition, the ground structure 95 having the container shape serves as a reflector to improve radiation characteristics of the patch antenna 90.

The feeding portion 91 of the patch antenna 90 configured as described above radiates a radio signal in a thickness direction (for example, a downward direction) of the board 10.

Referring to FIG. 12, in this example, the first ground layer 97*a* and the second ground layer 97*b* are not be disposed in a region facing the feeding region 11*c* (see FIG. 10) defined on the first surface of the board 10. In more detail, in this example, the patch antenna 90 is disposed in only a region facing the ground region 11*b* and the element mounting portion 11*a*. Therefore, the chip antenna 100 and the patch antenna 90 are disposed so they do not face each other. This configuration significantly reduces interference between a radio signal radiated from a chip antenna 100 to be described below and the ground structure 95.

Although an example in which the patch antenna 90 includes the feeding electrode 92 and the non-feeding electrode 94 has been described, the patch antenna 90 may be modified in various ways. For example, the patch antenna 90 may be configured to include only the feeding electrode 92 if desired.

The patch antenna 90 configured as described above radiates a radio signal in the thickness direction of the board 10 (that is, in a direction perpendicular to the board 10).

The electronic element 50 is mounted on the element mounting portion 11*a* of the board 10. Although an example in which one electronic element 50 is mounted on the element mounting portion 11*a* of the board 10 has been described, a plurality of electronic elements may also be mounted on the element mounting portion 11*a* of the board 10 if desired.

The electronic element 50 includes at least one active element such as a signal processing element applying a radiation signal to the feeding portion 91 of the antenna. In addition, the electronic element 50 may also include a passive element if needed.

The chip antenna 100 may be any one of the chip antennas described in this application, and may be mounted on the board by a conductive adhesive or solder.

In the chip antenna 100, the ground portion 130*b* is mounted on the ground region 11*b*, and the radiation portion 130*a* and the director 130*c* are mounted on the feeding region 11*c*. In more detail, the ground portion 130*b*, the radiation portion 130*a*, and the director 130*c* of the chip antenna 100 are mounted on the board 10 by being bonded to the ground pad 12*b*, the feed pad 12*c*, and the dummy pad 12*d*, respectively.

The chip antenna module 1 configured as described above radiates radio waves having a horizontal polarization using the chip antennas 100, and radio waves having a vertical polarization using the patch antennas 90. That is, the chip antennas 100 are disposed at positions adjacent to edges of the first surface of the board 10 and radiate radio waves in a plane direction of the board 10 (for example, a horizontal direction of the board 10), and the patch antennas 90 are disposed on the second surface of the board 10 and radiate radio waves in the thickness direction of the board 10 (for example, a vertical direction of the board 10). Therefore, a radiation efficiency of the radio waves is improved.

In addition, in the chip antenna module 1, two chip antennas 100 disposed in a pair function as a dipole antenna.

The two chip antennas 100 disposed in a pair are spaced apart from each other by a predetermined distance, and form one dipole antenna structure. A distance between the two chip antennas 100 is 0.2 mm to 0.5 mm. When the distance is less than 0.2 mm, interference is generated between the two chip antennas 100, and when the distance is 0.5 mm or more, a function of the dipole antenna is deteriorated.

Another possibility would be to form the dipole antenna from the wiring layers of the board 10 instead of using the chip antennas 100. However, in this example, a radiation portion of the dipole antenna needs to have a length of a half wavelength of a corresponding frequency, and an area occupied by a feeding region in the board 10 in which the dipole antenna would be disposed in the board 10 would thus be relatively large.

On the other hand, when a pair of the chip antennas 100 are used to form the dipole antenna as in this example, a size of the chip antennas 100 may be significantly reduced by a dielectric constant (for example, 10 or more) of the first block 120*a*.

For example, when the dipole antenna is formed from wiring patterns on the first surface of the board 10, a feeding line of the dipole antenna needs to be spaced apart from the ground region 11*b* by 1 mm or more. On the other hand, when the pair of the chip antennas 100 are used, the feed pads 12*c* may be spaced apart by 1 mm or less from the ground region 11*b*.

Therefore, a size of the feeding region 11*c* may be reduced in the example of using the pair of chip antennas 100 as compared to the example of using the dipole antenna formed from the wiring patterns, and an overall size of the chip antenna module 1 may thus be significantly reduced.

If a distance P between the radiation portion 130*a* of the chip antenna 100 and the ground region 11*b* is less than 0.2 mm, a resonant frequency of the chip antenna 100 may be changed. Therefore, in this example, the radiation portion 130*a* of the chip antenna 100 and the ground region 11*b* of the board 10 are spaced apart from each other in a range of 0.2 or more to 1 mm or less.

In addition, the chip antenna 100 is disposed at a position at which it does not face the patch antennas 90 in the vertical direction of the board 10. The position at which the chip antenna 100 does not face the patch antennas 90 in the vertical direction of the board 10 is a position at which the chip antenna 100 does not overlap the patch antennas 90 when the chip antenna 100 is projected on the second surface of the board 10 in the vertical direction of the board 10.

In this example, the chip antenna 100 is also disposed so that it does not face the ground structure 95. However, the chip antenna is not limited thereto, but may also be disposed to partially face the ground structure 95 if desired.

The configuration of the chip antenna module 1 described significantly reduces interference between the chip antennas 100 and the patch antennas 90.

Figure 13:
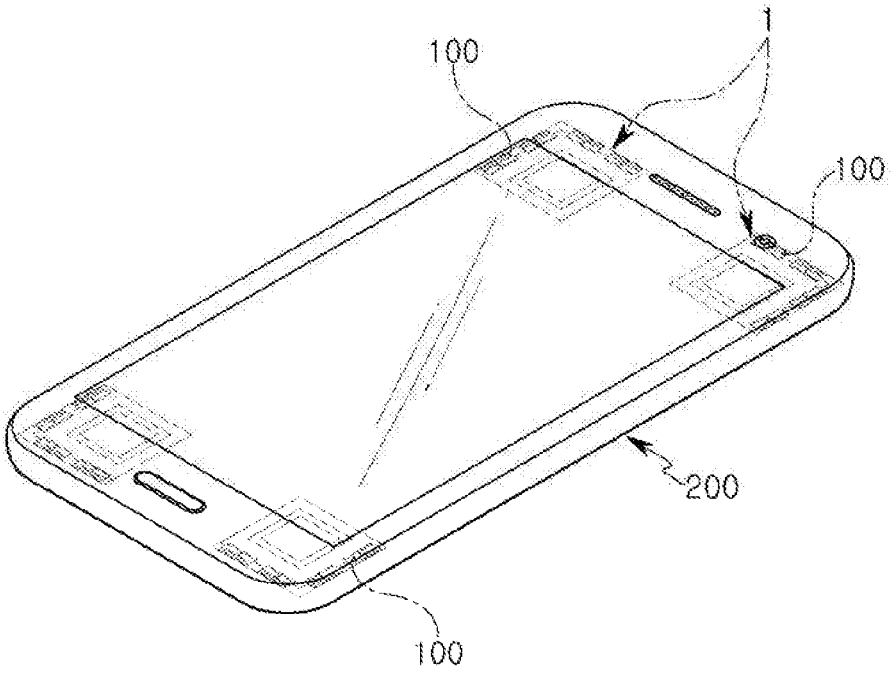
FIG. 13 is a schematic perspective view illustrating an example of a mobile terminal in which several of the chip antenna module illustrated in FIG. 10 are mounted.

FIG. 13 is a schematic perspective view illustrating an example of a mobile terminal in which several of the chip antenna module illustrated in FIG. 10 are mounted.

Referring to FIG. 13, four of the chip antenna module 1 illustrated in FIG. 10 are disposed at corner portions of a mobile terminal 200. In this example, the chip antenna modules 1 are disposed so that the chip antennas 100 are adjacent to corners (or vertices) of the mobile terminal 200.

Although FIG. 13 shows an example in which the chip antenna modules 1 are disposed at all of four corners of the mobile terminal 200, an arrangement in which the chip antenna modules 1 are disposed is not limited thereto, but may be modified in various ways if desired. For example, when an internal space of the mobile terminal is insufficient, only two chip antenna modules 1 may be disposed at diagonally opposite corners of the mobile terminal 200.

In addition, the chip antenna modules 1 may be mounted in the mobile terminal 200 so that feeding regions of the chip antennal modules 1 are disposed adjacent to edges of the mobile terminal 200. Therefore, radio waves radiated by the chip antennas 100 of the chip antenna modules 1 may be radiated in a plane direction of the mobile terminal 200 toward the outside of the mobile terminal 200. In addition, radio waves radiated by the patch antennas 90 of the chip antenna modules 1 may be radiated in a thickness direction of the mobile terminal 200.

As described above, the chip antenna module 1 uses a pair of the chip antennas 100 rather than a dipole antenna having a wiring form, and a size of the chip antenna module 1 is thus significantly reduced. In addition, a transmission and reception efficiency of signals is improved.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna for radio communications in a millimeter wave communications band, the chip antenna being configured to be mounted on a board, receive a feed signal from a signal processing element, and externally radiate the feed signal, the chip antenna comprising:

a radiation portion having a block shape, and a first surface and a second surface opposing each other, and configured to receive and radiate the feed signal as an electromagnetic wave;

a first block made of a dielectric material and coupled to the first surface of the radiation portion;

a second block made of a dielectric material and coupled to the second surface of the radiation portion;

a ground portion having a block shape, coupled to the first block side so that the first block is between the ground portion and the radiation portion, and configured to reflect the electromagnetic wave radiated by the radiation portion back toward the radiation portion; and a director having a block shape and coupled to the second block so that the second block is between the director and the radiation portion, wherein an overall width of the ground portion, the first block, and the radiation portion is 2 mm or less, the first block has a dielectric constant of 3.5 or more to 25 or less, and the chip antenna has a hexahedral shape and a surface configured to be mounted on a surface of the board so that the radiation portion and the ground portion are mounted on the surface of the board.

2. The chip antenna of claim 1, wherein the second block is made of the same dielectric material as the first block.

3. A chip antenna for radio communications in a millimeter wave communications band, the chip antenna being configured to be mounted on a board, receive a feed signal from a signal processing element, and externally radiate the feed signal, the chip antenna comprising:

a radiation portion having a block shape, and a first surface and a second surface opposing each other, and configured to receive and radiate the feed signal as an electromagnetic wave;

a first block made of a dielectric material and coupled to the first surface of the radiation portion;

a second block made of a dielectric material and coupled to the second surface of the radiation portion;

a ground portion having a block shape, coupled to the first block so that the first block is between the ground portion and the radiation portion, and configured to reflect the electromagnetic wave radiated by the radiation portion back toward the radiation portion; and a director having a block shape and coupled to the second block so that the second block is between the director and the radiation portion, wherein an overall width of the ground portion, the first block, and the radiation portion is 2 mm or less, the first block has a dielectric constant of 3.5 or more to 25 or less, and each of the radiation portion, the ground portion, and the director comprises:

a first conductor bonded to either one or both of the first block and the second block; and a second conductor disposed on a surface of the first conductor.

4. The chip antenna of claim 1, wherein the first block has a first surface to which the radiation portion is bonded and a second surface to which the ground portion is bonded, the second block has a first surface to which the radiation portion is bonded and a second surface to which the director is bonded, and a distance between the first surface and the second surface of the first block is greater than a distance between the first surface and the second surface of the second block.

5. The chip antenna of claim 1, wherein a distance between a first surface of the ground portion bonded to the first block and a second surface of the ground portion opposing the first surface of the ground portion is greater than a distance between a first surface of the radiation portion bonded to the first block and a second surface of the radiation portion opposing the first surface of the radiation portion.

6. The chip antenna of claim 1, wherein a size of the director is the same as a size of the radiation portion.

7. The chip antenna of claim 1, wherein a length of the director is smaller than a length of the radiation portion.

8. The chip antenna of claim 7, wherein a length of the second block is the same as a length of the director.

9. The chip antenna of claim 1, wherein the radiation portion comprises a first radiation portion and a second radiation portion spaced apart from each other, and the director comprises a first director and a second director spaced apart from each other.

10. The chip antenna of claim 9, wherein the ground portion comprises a first ground portion and a second ground portion spaced apart from each other, the first ground portion is disposed on a straight line with the first radiation portion and the first director, and the second ground portion is disposed on a straight line with the second radiation portion and the second director.

11. The chip antenna of claim 1, wherein the surface of the chip antenna is further configured to be mounted on the surface of the board so that the director is mounted on the surface of the board.

12. The chip antenna of claim 1, wherein the radiation portion has a third surface perpendicular to the first surface of the radiation portion and the second surface of the radiation portion, the ground portion has a first surface and a second surface opposing each other, and a third surface perpendicular to the first surface of the ground portion and the second surface of the ground portion, the second surface of the ground portion being coupled to the first block, and the surface of the chip antenna comprises the third surface of the radiation portion and the third surface of the ground portion, and is further configured to be mounted on the surface of the board so that the third surface of the radiation portion and the third surface of the ground portion are mounted on the surface of the board.

13. The chip antenna of claim 12, wherein the director has a first surface and a second surface opposing each other, and a third surface perpendicular to the first surface of the director and the second surface of the director, the first surface of the director being coupled to the second block, and the surface of the chip antenna further comprises the third surface of the director, and is further configured to be mounted on the surface of the board so that the third surface of the director is mounted on the surface of the board.

14. A chip antenna for radio communications in a millimeter wave communications band, the chip antenna being configured to be mounted on a board, receive a feed signal from a signal processing element, and externally radiate the feed signal, the chip antenna comprising:

a radiation portion having a block shape, a first surface and a second surface opposing each other, and a third surface perpendicular to the first surface of the radiation portion and the second surface of the radiation portion, the radiation portion being configured to receive and radiate the feed signal as an electromagnetic wave;

a first block made of a dielectric material and having a first surface and a second surface opposing each other, the second surface of the first block being coupled to the first surface of the radiation portion;

a second block made of a dielectric material and having a first surface and a second surface opposing each other, the first surface of the second block being coupled to the second surface of the radiation portion;

a ground portion having a block shape, a first surface and a second surface opposing each other, and a third surface perpendicular to the first surface of the ground portion and the second surface of the ground portion, the second surface of the ground portion being coupled to the first surface of the first block so that the first block is between the ground portion and the radiation portion, the ground portion being configured to reflect the electromagnetic wave radiated by the radiation portion back toward the radiation portion; and a director having a block shape and a first surface and a second surface opposing each other, the first surface of the director being coupled to the second surface of the second block so that the second block is between the director and the radiation portion, wherein an overall width of the ground portion, the first block, and the radiation portion is 2 mm or less, the first block has a dielectric constant of 3.5 or more to 25 or less, and the chip antenna has a hexahedral shape and a surface comprising the third surface of the radiation portion and the third surface of the ground portion, the surface of the chip antenna being configured to be mounted on a surface of the board so that the third surface of the radiation portion and the third surface of the ground portion are mounted on the surface of the board.

15. The chip antenna of claim 14, wherein the director has a third surface perpendicular to the first surface of the director and the second surface of the director, and the surface of the chip antenna further comprises the third surface of the director, and is further configured to be mounted on the surface of the board so that the third surface of the director is mounted on the surface of the board.

* * * * *